US005183028A

United States Patent [19]

Traeger et al.

[11] Patent Number: 5,183,028

[45] Date of Patent: Feb. 2, 1993

[54] BURNING APPARATUS WITH PELLET FUEL BURNER

[76] Inventors: Joseph P. Traeger, 250 S. Oak St.; Mark A. Traeuger, 530 Alder St.; Randolph J. Traeger, 540 Leo St., all of Mt. Angel, Oreg. 97362

[21] Appl. No.: 804,243

[22] Filed: Dec. 9, 1991

[51] Int. Cl.[5] ..... F24B 13/04

[52] U.S. Cl. ..... 126/73; 126/501; 126/519; 431/125; 110/102; 110/108

[58] Field of Search ..... 126/73, 501, 519, 500, 126/68, 73; 110/108, 102, 116, 117, 118; 431/125

[56] References Cited

U.S. PATENT DOCUMENTS 4,112,913 9/1978 Shimek et al. ..... 126/519
4,351,315 9/1982 Babbage ..... 126/501
4,989,521 2/1991 Traeger et al. ..... 110/108
5,026,271 6/1991 Orlov et al. ..... 431/125
5,067,476 11/1991 Rhodes, Jr. ..... 431/125 X

*Primary Examiner*—Larry Jones
*Attorney, Agent, or Firm*—Kolisch Hartwell Dickinson McCormack & Heuser

[57] ABSTRACT

A pellet fuel burning apparatus which includes a housing and a display chamber defined within the housing. Window structure enables viewing of the interior of the chamber from outside the housing. Pellet fuel is burned in a zone remote from the display chamber. Flames and gaseous combustion products from the pellet fuel fire are channel upwardly into the display chamber against simulated logs.

9 Claims, 1 Drawing Sheet

BURNING APPARATUS WITH PELLET FUEL BURNER

BACKGROUND AND SUMMARY OF THE INVENTION

This invention relates to burning apparatus, and more particularly to a burning apparatus which has a housing structure with a chamber defined therein, and means for the burning of fuel such as pellet fuel in a burning zone remote from the chamber.

An increasingly popular wood fuel product which is available today is so-called pellet fuel, taking the form of compressed pellets of wood material. The pellets may be made from a variety of wood materials including sawdust and other residues and typically have lengths ranging from ¾" to 1½". Another example of what might be thought of as pellet fuel is comminuted poplar, or comminuted residues such as corn husks or nut shells. Whatever the particular description of the fuel, the fuel characteristically has a fairly uniform size, can be handled in a storage facility such as a hopper, and burns evenly when ignited and supplied with combustion supporting gas such as air.

This invention relates to a stove or burning apparatus which utilizes pellet fuel as broadly defined as the source of energy, and is constructed in such a manner as to provide an efficient and reliable source of heat.

Yet another object is to provide fuel burning apparatus where the burning of pellet fuel takes place in one zone of the apparatus, and air together with gaseous combustion products from this preliminary burning are channeled by a tunnel into a chamber. In this chamber air and combustion products from the burning zone are channeled against a baffle which breaks up the flow of gaseous material with heating of the chamber throughout. From the chamber the combustion products are expelled into the atmosphere on traveling through an exhaust pipe or vent.

In a preferred, and the particular embodiment of the invention herein disclosed, the chamber described is a display chamber, at least partially bounded by window structure permitting user viewing of the interior of the chamber. The baffle is formed by nonflammable structure, such as simulated logs made of concrete or other nonflammable material, placed within the display chamber over the opening. With a fire established within the burning zone, flame and combustion products are carried upwardly into the display chamber and against the simulated logs to produce a realistic appearing log fire.

With the burning apparatus contemplated burning pellet fuel, the apparatus lends itself for use in locations where a fuel supply, such as piped gas, is not available. For instance, it can be set up in an outdoor patio area, or at pool side, or at remote locations where utility service is not available, to provide when needed a source of heat, and a warm and inviting atmosphere.

Objects of the invention, therefore, comprise the provision of a novel burning apparatus which utilizes combustible pellets as a fuel.

Another object is to provide such apparatus where the pellets are gravity fed, making the apparatus useable at locations where electrical power is not conveniently provided.

A further object is to provide such which provides when operating not only a source of heat but also the visual appearance of a natural log fire.

BRIEF DESCRIPTION OF THE DRAWINGS

Other features, objects, and advantages are attained by the invention, and the invention is described hereinbelow in conjunction with the accompanying drawings, wherein.

DETAILED DESCRIPTION OF A PREFERRED EMBODIMENT

Figure 1:
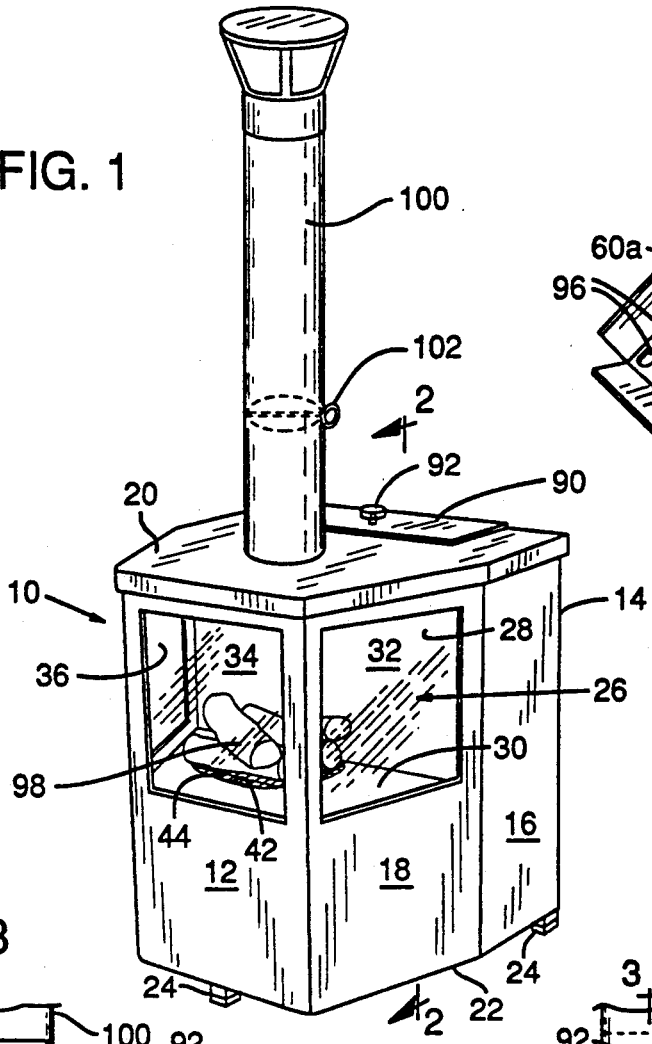
FIG. 1 is a perspective view illustrating fuel burning apparatus incorporating the invention.
Figure 4:
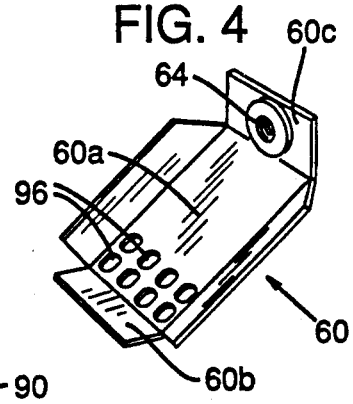
FIG. 4 is a perspective view of a chute assembly in the apparatus.
Figure 3:
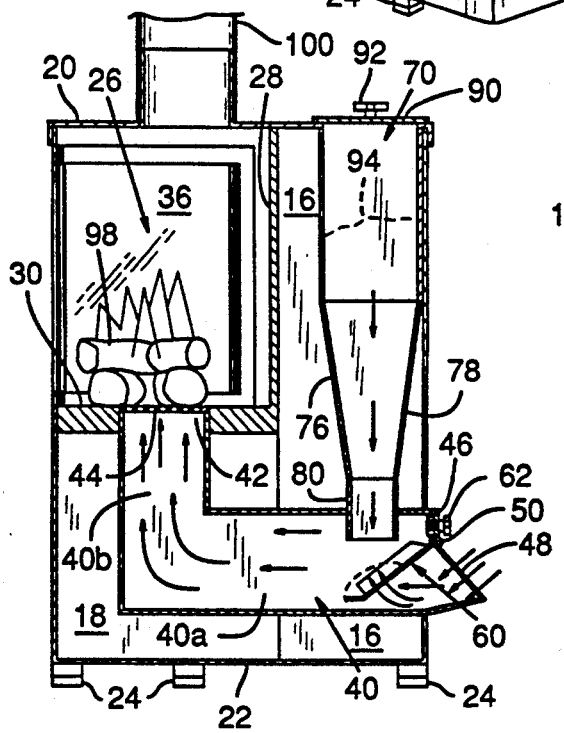
FIG. 3 is a cross-sectional view taken generally along the line 3—3 in FIG. 2.
Figure 2:
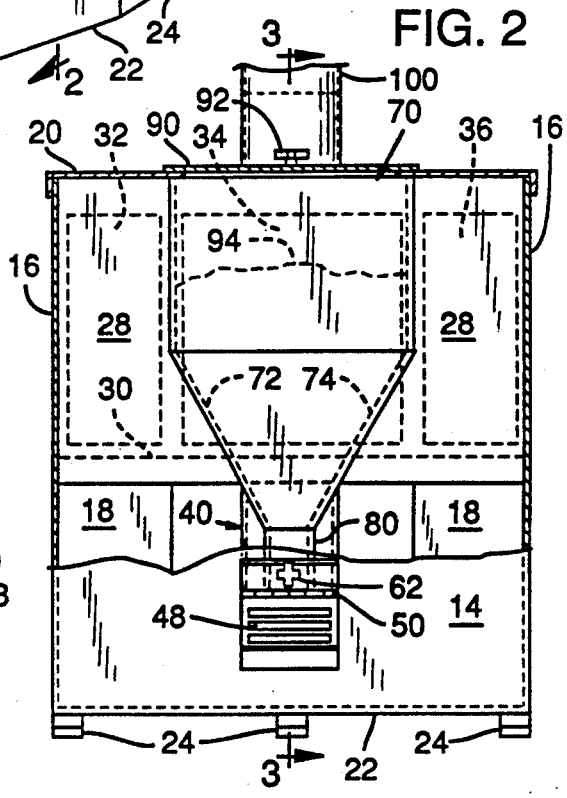
FIG. 2 is a cross-sectional view, on a somewhat larger scale, taken generally along the line 2—2 in FIG. 1.

Referring to the drawings, what is illustrated is a burning apparatus sometimes referred to as a patio fireplace, since the apparatus is easily set up on a patio or in a like area to provide, when operating, the appearance and warmth of a natural wood fire burning on a framed hearth.

The burning apparatus includes a metal housing or housing structure 10 with a front side which faces to the viewer and toward the left in FIG. 1, and a rear side which faces to the right away from the viewer in this figure. The housing includes a front wall 12 and a rear wall 14. Each side of the housing is formed by a side wall, such as side wall 16, which is normal to rear wall 14, and a side wall, such as side wall 18, which extends at an obtuse angle with respect to side wall 16. The top and bottom of the housing structure are formed by panels 20 and 22. Supporting the housing structure on the ground are legs such as those shown at 24 projecting downwardly from panel 22.

Defined within the housing structure is what is referred to as a display chamber 26. The display chamber is bounded by a back wall 28 within the housing structure and a floor or base 30. The top of the display chamber is formed by a forward portion of top panel 20. Window structure has been provided which permits user viewing of the interior of the display chamber from outside the housing structure. Specifically, this window structure takes the form of three windows, namely window 32 in side wall 18 which faces toward the viewer and to the right in FIG. 1, window 34 which faces to the front and left in FIG. 1, and window 36 which faces away from the viewer in FIG. 1. These windows are made from conventional nonflammable transparent window material.

Extending along the interior of the housing structure is what is referred to herein as an elongate tunnel 40. This tunnel includes a horizontal extent **40*a* which extends from the rear toward the front of the housing adjacent bottom panel 22, and a vertical extent 40*b* which extends upwardly and through an opening 42 in the floor of the display chamber whereby the interior of the tunnel communicates with the interior of chamber 26. If desired, and to prevent material from dropping inadvertently downwardly into the tunnel, a grate 44 may be provided at the top of tunnel 40 where such joins with chamber 26**.

Tunnel 40 has a rear end which extends through the rear wall of the housing structure a slight distance and thence inclines upwardly. This exposed end of the tunnel is partially closed by a lip 46 and a hinged spark arrester 48 which is hingedly mounted by hinge 50 on a margin of this lip. The spark arrester is perforate to permit air to flow through the spark arrester and support combustion in a burning zone adjacent the rear of the tunnel.

Mounted within the tunnel adjacent its rear end is a chute and shelf unit of assembly 60. The unit includes a chute portion 60*a*, a shelf portion 60*b*, and a tab portion 60*c*. Tab portion 60*c* fits against the inside of lip 46. A screw with a knob end 62 and with its threaded end screwed into threaded bore 64 of the chute and shelf unit holds the chute and shelf unit detachably in place within the tunnel.

A hopper for holding a supply of pellet fuel is provided within the housing structure. Specifically, the hopper is shown at 70. The hopper includes inclined side walls 72, 74, 76, and 78 tunneling material to a feed opening defined at the base of skirt structure 80.

The top of the housing structure in the region over the top of hopper 70 includes a removable cover 90 provided with a knob 92. With the cover removed, pellet fuel may be loaded into the hopper as exemplified by the fuel indicated by the outline 94.

Chute portion 60*a* and unit 60 has perforations 96. With a mass of pellet fuel supported on the unit and burning, these perforations permit air flow through the unit to support combustion. Air flow is also permitted under and around the sides of the unit by reason of the spacing of the base and sides of the unit inwardly from the sides of the tunnel. This air travels inwardly into the tunnel through the spark arrester as earlier described.

Within the display chamber and over grate 44 is a nonflammable fuel simulator given the reference numeral 98. This may, for instance, take the form of concrete logs having the position of wood logs in an actual fire. The simulator has height as well as length and breadth. Hot gases and flames of combustion travel upwardly through the tunnel to be broken up and dispersed by the logs as by a baffle. These materials then travel further into the interior of the display chamber.

Combustion products exhaust from the display chamber through vent pipe 100. If desired, such may be provided with a damper such as the one shown at 102 to control air flow through the vent pipe.

Describing operation of the unit, pellet fuel falls downwardly from the hopper to buildup as a mass on the chute and shelf unit with this mass eventually stopping further flow of fuel downwardly. It is an easy matter to start combustion in this mass of fuel using a match and a small amount of lighter fuel. With burning started, a draft is quickly established with air being drawn inwardly into the tunnel and thence upwardly through the display chamber to be expelled from the vent pipe 100. With ignition started, air and partially combusted materials and flame are carried away from the burning mass and through the tunnel to be expelled through opening 42 against the fuel simulator or logs 98. To persons viewing the interior of the display chamber from outside the unit, the visual appearance of a very natural fire is produced. Additionally, of course, heat is produced with the walls of the housing structure becoming heated and radiating such heat outwardly.

With the structure described, pellets will gravitate from the bottom of the hopper as fuel is consumed during the burning process. Thus, burning continues with automatic replenishing of fuel as long as there is fuel remaining in the hopper. During this time, there is no need to tend to the fire which appears to be taking place within the display chamber. This is very convenient in a unit functioning as a patio fireplace, since it is rare in such an environment for a person to assume the responsibility of tending to a fire to see that such continues to burn.

It should be obvious that what has been described is a unit which is easily started up and requires little tending. Constructions are possible for units minimizing their bulk and rendering them of light mass. This imparts a degree of portability to the unit, which is a desirable feature in many applications.

While embodiments of the invention have been described, obviously variations and modifications are possible without departing from the invention.

It is claimed and desired to secure by Letters Patent:

1. A stove comprising:

a housing, a display chamber defined within the housing and said chamber being bounded on one side by an external window structure permitting user viewing of an interior region of the chamber from outside the housing, said chamber having a base and an opening in said base at said interior region, a nonflammable fuel simulator disposed above said opening, a burning zone in said housing spaced below said chamber for burning pellet fuel, a tunnel leading from said burning zone to said opening channeling combustion gases produced in said zone into said opening and across said fuel simulator and, a passage connecting with the burning zone for introducing combustion supporting air to said zone.

2. The stove of claim 1, wherein said fuel simulator projects upwardly from the base of the display chamber, the fuel simulator has a length and breadth extending between ends and sides, and said opening directs combustion gases across the simulator at a location disposed inwardly from said ends and sides.

3. The stove of claim 1, wherein said external window structure includes at least a pair of windows extending at an angle with respect to each other, and said windows enable viewing of the display chamber from different perspectives.

4. The stove of claim 1, wherein the window structure includes a window extending upwardly along the front of the housing and said burning zone is disposed below and toward the rear of said chamber from said opening.

5. The stove of claim 4, which further includes a fuel storage hopper disposed at the rear of the housing and said hopper includes structure for feeding fuel from the hopper into said burning zone.

6. A stove comprising:

a housing, a chamber defined within the housing having a base, an opening in the base of the chamber, baffle structure adjacent the base of the chamber and disposed above said opening for breaking the flow of gasses directed upwardly through said opening against the baffle structure, a burning zone in said housing spaced below said chamber for burning pellet fuel, a tunnel leading from said burning zone and connecting with said opening and a passage connecting with the burning zone for introducing combustion supporting air to said zone.

7. The stove of claim 6, wherein said burning zone includes a shelf for holding pellet fuel, a chute for directing pellet fuel onto the shelf, and said tunnel extends about the chute and the shelf.

8. The stove of claim 7, which further includes a hopper defined within the housing for holding a supply of pellet fuel, and said hopper is located upwardly from the chute and has an opening at the base thereof for the gravity feeding of pellets from the hopper onto the chute.

9. Pellet burning apparatus comprising:

a housing, a chamber defined within the housing, an opening at the base of the chamber, a vent pipe extending upwardly from the top of the chamber, a burning zone defined in said housing spaced from said chamber for burning pellet fuel, a tunnel connecting the burning zone and said opening operable to channel gaseous combustion material produced in the burning zone through said opening and into said chamber with said gaseous material leaving the chamber through said vent, a passage connecting with said burning zone for introducing combustion supporting air to said zone, and baffle structure adjacent the base of the chamber disposed above said opening for breaking up the flow of gaseous material upwardly from said opening.

* * * * *